US005775341A

United States Patent [19]

Abe et al.

[11] Patent Number: 5,775,341

[45] Date of Patent: Jul. 7, 1998

[54] METHOD FOR HAIR JOINING AND HAIR-JOINING DEVICE USED FOR THE SAME

[75] Inventors: Tomoko Abe; Mutsumi Kawasaki, both of Niigata-ken, Japan

[73] Assignee: Aderans Co., Ltd., Tokyo, Japan

[21] Appl. No.: 829,817

[22] Filed: Mar. 25, 1997

[30] Foreign Application Priority Data

Mar. 26, 1996 [JP] Japan ..... 8-094649

[51] Int. Cl.[6] ..... A41G 3/00; A41G 5/00

[52] U.S. Cl. ..... 132/201; 132/200; 132/53; 132/212

[58] Field of Search ..... 132/201, 53, 200, 132/207, 212

[56] References Cited

U.S. PATENT DOCUMENTS

| | | | |
|---|---|---|---|
| 5,497,796 | 3/1996 | Mochizuki et al. | 132/201 |
| 5,533,529 | 7/1996 | Ohno | 132/201 |
| 5,558,105 | 9/1996 | Rosenwinkle et al. | 132/200 |

FOREIGN PATENT DOCUMENTS

| | | | |
|---|---|---|---|
| 7-96722 | 10/1995 | Japan . | |
| 8-92809 | 4/1996 | Japan . | |
| 8092809 | 4/1996 | Japan | 132/201 |
| 2511747 | 7/1996 | Japan . | |
| 2549565 | 10/1996 | Japan . | |
| 2610579 | 5/1997 | Japan . | |

*Primary Examiner*—John J. Wilson
*Assistant Examiner*—Pedro Philogene
*Attorney, Agent, or Firm*—Fish & Richardson P.C.

[57] ABSTRACT

A method for joining hair includes the steps of winding joining hair around and loosely knotting the same to a rod member, which is provided on one end thereof with a loop portion having flexibility, unit by unit, at predetermined intervals, withdrawing the joining hair wound around and loosely knotted to the rod member, unit by unit, through the loop portion after a strand of natural hair on the scalp of a person's head is inserted into the loop portion, and tightly knotting a knot portion of the joining hair thus withdrawn, by pulling opposite ends of the joining hair so that the joining hair is tied to the natural hair strand at the knot portion. A hair-joining device used in this method comprises a rod member provided on one end thereof with a loop portion having flexibility, and the rod member having joining hair which is wound around and loosely knotted to the rod member, unit by unit, at predetermined intervals. It is very advantageous if the hair-joining device comprises an inner rod member provided on one end thereof with a loop portion, the inner rod member having joining hair which is wound around and loosely knotted to the inner rod member, unit by unit, at predetermined intervals, and an outer cylindrical member for receiving therein the inner rod member having the joining hair. According to the invention, joining hair can be firmly tied to natural hair on the scalp of a person's head in an efficient manner, using a loop portion normally having a constant dimension.

22 Claims, 8 Drawing Sheets

METHOD FOR HAIR JOINING AND HAIR-JOINING DEVICE USED FOR THE SAME

BACKGROUND OF THE INVENTION

1. Field of the Invention

This invention relates to a method for hair joining, and a hair-joining device used in the method, in which joining-hair is secured to thin hair on a scalp of a person's head or hair implanted in a wig for the purpose of relatively increasing the number of hair strands implanted in the scalp or the wig.

2. Description of the Related Art

There is widely employed a technology for joining hair to individual strands of hair on a scalp of a person's head on which a comparatively large amount of hair is still left in an early stage of hair falling, in order to relatively increase a total hair amount on the scalp, utilizing the hair still left on the scalp. Also, there is generally employed a technology in which when a new wig is made, a rather small amount of hair is beforehand implanted on a wig base and the hair is appropriately increased in accordance with a client's request, or when the hair implanted on a wig is partially fallen out due to long use of the wig, additional joining hair is joined to the hair remaining on the wig, thereby relatively increasing the total amount of hair on the wig.

For example, Japanese Laid-Open Patent Publication No. Sho 61(1986)-97409 discloses a method in which a single strand or a group of strands of joining hair is bonded to a single strand of natural hair on the scalp of a person's head by an adhesive. According to this method, a single strand or a group of 2 to 6 strands of joining hair cut into a proper length are aligned at one end thereof and placed along a single strand of natural hair, and then bonded at basal end portions of the joining hair strands to the root portion of the natural hair in the manner as to form a branch while applying an adhesive. As the adhesive, silicon resins, polyurethane resins or epoxy resins are used.

However, since the adhesives of silicon or polyurethane resins take long time for hardening, workability is bad. On the other hand, the adhesive of epoxy resins tend to cause itching, rash, eruption, etc. on the skin and therefore, they are not suitable in view of safety. In order to elude these problems, there is proposed a hair thickening method in which a hot melt adhesive is used instead of the above-mentioned adhesive. This method is laid open to public inspection as the invention of the present application, on Jun. 28, 1991, under Japanese Laid-Open Patent Publication No. Hei 3(1986)-152205. According to this method, a group of joining hair is spirally wound around an area in the vicinity of the root portion of a single strand of natural hair and then, a hot melt adhesive applied to the grouped hair strands at the area in the vicinity base end portions and hardened is softened by heating and then bonded to the single strand of natural hair. Thereafter, they are left as they are under normal temperature until the adhesive is cooled and hardened, whereby the joining hair is firmly attached to the natural hair.

Since the hot melt adhesive does not take long time for softening and hardening, workability is good. Moreover, since the hot melt adhesive hardly reacts with the scalp, it is safe. However, since the joining hair strands are attached to the natural hair in the condition that the hot melt adhesive is softened by heating, the use of an instrument such as a heated trowel is necessary when the joining hair strands are attached to the natural hair. Therefore, handling is difficult. Besides, there is a possibility that the scalp is burnt when the heating trowel of high temperature is inadvertently left in contact with the scalp for a long time.

At any rate, according to the teaching of the above technology, when joining hair is tied to an area in the vicinity of the root portion of the natural hair on the scalp of a person's head, a single strand of natural hair is held with a finger(s) of one hand, and while maintaining this condition, a hair implanting needle held with a finger(s) of the other hand is brought into engagement with a generally central portion of a folded part of the joining hair and then, the needle is carefully manipulated so that the joining hair is wound around the area in the vicinity of the nearest possible area to the root of the natural hair. Subsequently, a free end portion of the natural hair is pierced through a ring-shaped folded-back portion and tightly tied. As seen, for tying a few joining hair strands to a single natural hair strand, it is required such an extremely troublesome work that while holding the single natural hair strand with a finger(s) of one hand, a loop or ring of the joining hair is formed with a finger(s) of the other hand. Obviously, it will take a considerably long time period for the work for tying the joining hair strands to, for example, 1,000 or more strands of natural hair.

In view of the above, there is proposed a technology by Japanese Patent Publication No. Hei 7-96722 of Oct. 18, 1995. According to this publication, a plurality of units of joining hair strands are beforehand wound around a sleeve-like member at appropriate intervals. Then, when the joining hair is tied to the natural hair on the scalp of a person's head, a single strand of natural hair is inserted into this sleeve-like member and in that condition, the joining hair on the heading side is gradually removed from the sleeve-like member and wound around the single strand of natural hair and tightly tied thereto. However, this technology has such a shortcoming that when a single or plurality of units of joining hair wound around the sleeve-like member should be slipped in position or loosened, they would get tangle in adjacent units of joining hair and as a result, the joining hair would not be able to be removed, unit by unit, smoothly from the sleeve-like member.

U.S. Pat. Ser. No. 5, 497,796 discloses a joining hair retainer in which the joining hair is aligned at one end and retained so that adjacent units of joining hair will not be tangled with each other.

It is true that if this retainer is used, the adjacent units of joining hair are not tangled with each other and can be retained smoothly. However, since it is necessary to remove the sleeve-like member from the base plate during the hair joining work, the problem of complicated work cannot be obviated yet.

In view of the above, it is, therefore, an object of the present invention to provide a method for hair joining, in which the hair joining work can easily be done by anybody and can efficiently be done in a comparatively short time period.

It is another object of the invention to provide a hair-joining device, in which several hundreds to several thousands of joining hair strands are beforehand prepared in such a state that barbers or hair dressers can immediately use them, whereby the hair joining work can be done in a highly efficient manner.

SUMMARY OF THE INVENTION

From one aspect of the present invention, there is essentially provided a method for joining hair in which joining hair is tied to natural hair on the scalp of a person's head, the method including the steps of winding joining hair around and loosely knotting the same to a rod member, unit by unit, at predetermined intervals, which rod member is provided on one end thereof with a loop portion having flexibility, withdrawing the joining hair wound around and loosely knotted to the rod member, unit by unit, through the loop portion after a strand of natural hair on the scalp of a person's head is inserted into the loop portion, and tightly knotting a knot portion of the joining hair thus withdrawn by pulling opposite ends of the joining hair so that the joining hair is tied to the natural hair strand at the knot portion.

Preferably, the joining hair, a plurality of strands (for example, three strands) of which constitute one unit of joining hair, is wound around and loosely knotted to the rod member, unit by unit, at generally equal intervals.

The rod member may be a cylindrical body, and the loop portion is preferably fixedly inserted into one end of the rod member.

According to the method for joining hair thus constructed, for tying the joining hair to the living hair, the living hair is inserted into the loop portion formed on the distal end of the rod member first and then, a single unit of the joining hair strands wound around and loosely knotted to the rod member is withdrawn through the loop portion and the living hair is withdrawn through the loop portion of the rod member. By doing so, the living hair can easily be pierced through the knot of the joining hair. After the living hair is pierced through the knot of the joining hair, the joining hair is brought to the root portion of the living hair and then, opposite ends of the joining hair are pulled in opposite directions so that the joining hair can easily and tightly be tied to the living hair. Therefore, according to the present invention, since it is unnecessary to form a ring or loop on the joining hair and tied each time the hair joining work is performed, the hair joining work becomes simple and working efficiency is enhanced.

The rod member may have a plurality of beads loosely fitted thereto, and the joining hair may be wound around and loosely knotted to the rod member at area between the beads.

Owing to the feature of the beads being loosely fitted to the rod member, when a bead located backwardly of the joining hair to be joined is manually pushed to slide for the purpose of withdrawing the joining hair from the rod member, the joining hair located forwardly of the bead is pushed by this particular bead so that the bead is slippingly moved. This makes it easy to withdraw the joining hair from the rod member. Moreover, since the joining hair is retained, unit by unit, by the beads which are in alternate relation with the joining hair, at predetermined intervals, the adjacent units of joining hair are prevented from being tangled with each other.

From another aspect of the present invention, there is also provided a method for joining hair in which joining hair is tied to natural hair on the scalp of a person's head, the method including the steps of winding joining hair around and loosely knotting the same to an inner rod member, unit by unit, at predetermined intervals, which rod member is provided on one end thereof with a loop portion having flexibility, inserting the inner rod member having the joining hair into an outer cylindrical member such that at least the loop portion of the inner rod member projects from one end of the outer cylindrical member, withdrawing the joining hair wound around and loosely knotted to the inner rod member, unit by unit, through the loop after a strand of natural hair on the scalp of a person's head is inserted into the loop portion, and tightly knotting a knot portion of the joining hair thus withdrawn by pulling opposite ends of the joining hair so that the joining hair is tied to the natural hair strand at the knot portion.

According to the method for joining hair thus constructed, since the joining hair is pushed into and nested in the outer cylindrical member, the joining hair, which is not yet used for the current joining work, is not permitted to loosely hang down. Therefore, the hair joining work can be performed in an efficient manner. In addition, since the joining hair is nested in the outer cylindrical member, the joining hair is prevented from being tangled with each other.

From another aspect of the present invention, there is also provided a hair-joining device comprising a rod member provided on one end thereof with a loop portion having flexibility, and the rod member having joining hair which is wound around and loosely knotted to the rod member, unit by unit, at predetermined intervals.

According to this invention, since the rod member is provided on one end thereof with a loop portion, for tying the joining hair to the living hair, the living hair is pierced into the loop portion and then, the joining hair, which is wound around and tied to the rod member, is withdrawn, unit by unit, through the loop portion and the living hair is withdrawn from the loop portion of the rod member. By means of this simple manipulation, the living hair can easily be pierced into the knot of the joining hair. Therefore, according to the present invention, since it is unnecessary to form a ring or loop on the joining hair and tied each time the hair joining work is performed, the hair joining work becomes simple and working efficiency is enhanced.

The rod member may have a plurality of beads loosely fitted thereto, and the joining hair may be wound around and loosely knotted to the rod member at area between the beads.

Owing to the feature of the beads being loosely fitted to the rod member, when a bead located backwardly of the joining hair to be joined is manually pushed to slide for the purpose of withdrawing the joining hair from the rod member, the joining hair located forwardly of the bead is pushed by this particular bead so that the bead is slippingly moved. This makes it easy to withdraw the joining hair from the rod member. Moreover, since the joining hair is retained, unit by unit, by the beads which are in alternate relation with the joining hair, at predetermined intervals, the adjacent units of joining hair are prevented from being tangled with each other.

The rod member can be tapered such that it is reduced in diameter on the one end side where the loop portion is provided, and gradually enlarged in diameter towards the other end side. Owing to the feature of the rod member being tapered (gradually reduced in diameter) towards the distal end side where the loop portion is formed, the joining hair located near the basal end side can easily be withdrawn from the rod member. In order to prevent the joining hair, which is wound around and loosely knotted to the rod member, from being tangled with each other, the tapered rod member may have a plurality of recesses formed therein at predetermined intervals along a circumference thereof, the recesses being so small that they are just enough in dimension to hold one unit of the joining hair, unit by unit, so that the joining hair will not accidentally slip. Owing to this feature, the adjacent joining hair can be prevented from being tangled with each other.

Instead of the tapered rod member, the rod member may be of a multi-stage expansible type. Owing to this feature, a sliding distance of the joining hair can be shortened by receiving the first rod into the second rod after the attaching work of the joining hair wound around and tied to the first rod located on the distal end side, is finished. Therefore, the hair joining work can be performed in an efficient manner.

From another aspect of the present invention, there is also provided a hair-joining device comprising an inner rod member provided on one end thereof with a loop portion having flexibility, the inner rod member having joining hair which is wound around and loosely knotted to the inner rod member, unit by unit, at predetermined intervals, and an outer cylindrical member for receiving therein the inner rod member having the joining hair such that at least the loop portion of the inner rod member projects from one end of the outer cylindrical member.

According to this construction, since the joining hair is pushed into and nested in the outer cylindrical member together with the inner rod member, the joining hair, which is not yet used for the current joining work, is not permitted to loosely hang down. Therefore, the hair joining work can be performed in an efficient manner. In addition, since the joining hair is nested in the outer cylindrical member, the joining hair is prevented from being tangled with each other.

The inner rod member and the outer cylindrical member can be formed by a small and a large hard plastic cylindrical body having generally the same length.

The rod member or the inner rod member to which the joining hair is to be tied, may be provided with a longitudinally-extending cut or groove for inserting a hook type hair implanting needle therein. Owing to a provision of the cut or groove, the hair can easily be hooked by the hair implanting needle and pulled towards the loop portion. In case the rod member or the inner rod member is a sleeve-like body, it may be formed to exhibit a C-shape in section in order that a cut of the type mentioned above can easily be formed.

The joining hair used in the above-mentioned respective inventions, may be designed such that a plurality of strands of the joining hair constitute one unit of joining hair and wound around and loosely knotted to the inner rod member, unit by unit, at generally equal intervals.

A large-sized hair-joining device may be formed, for example, by fixedly arranging, in parallel relation, 50 sets of hair-joining devices each having 50 units of joining hair strands, on a wide mount. Owing to this arrangement, since 2,500 units of joining hair strands are retained by the large-sized hair-joining device while maintaining the configuration of their knot, the hair joining work can be performed in a more efficient manner.

BRIEF DESCRIPTION OF THE DRAWINGS

The present invention will be understood more fully from the detailed description given below and from the accompanying drawings of the preferred embodiments of the invention, which, however, should not be taken to be limitative to the invention, but are for explanation and understanding only.

In the drawings.

DESCRIPTION OF THE PREFERRED EMBODIMENT

A method for joining hair and a hair-joining device used therein will now be described with reference to FIGS. 1 through 8.

Figure 1:
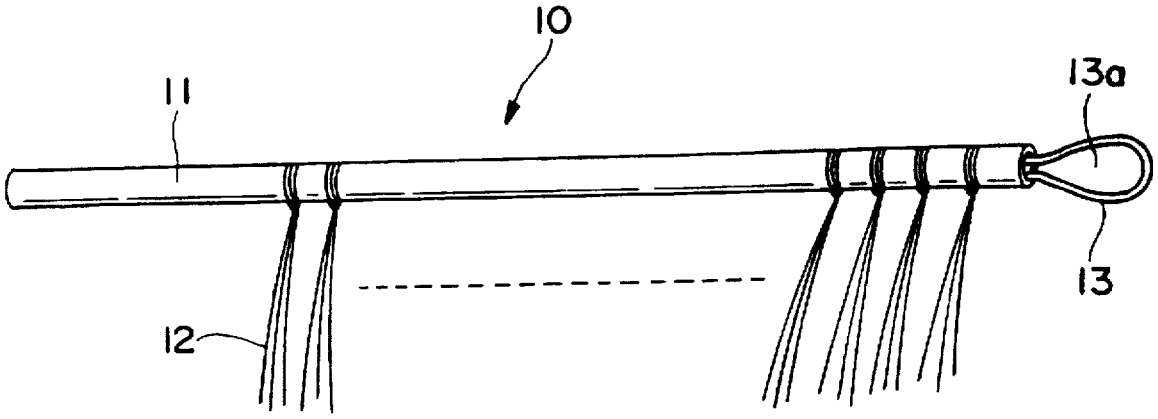
FIG. 1 is a perspective view showing the first embodiment of a hair-joining device according to the present invention.

Referring first to FIG. 1, one embodiment of a hair-joining device according to the present invention is described. A hair-joining device 10 basically comprises a rod member 11, joining hair 12 wound around and loosely knotted to an outer peripheral surface of the rod member 11 at predetermined intervals, and a loop portion 13*a* formed of a filament 13 having flexibility and attached to a distal end side of the rod member 11 in a way to project further from the distal end.

This rod member 11 is formed of a solid or hollow body made of plastic, wood or metal material. It is preferred that the rod member 11 is made of material hard or tough enough not to allow the rod member 11 to be broken or overly bent, which would otherwise be likely to occur due to heavy weight of the joining hair 12 particularly when a large number of units of joining hair strands are wound around and knotted to the rod member ii. The loop portion 13a formed on the distal end of the rod member 11 is constructed by bending the filament 13 made of flexible and preferably, plastic material. Free ends of the loop portion 13*a* are inserted into the distal end of the rod member 11 and fixedly secured thereto.

The joining hair 12 is selected from natural human hair or artificial hair which matches in color, thickness and length with the living hair on the scalp of a person's head who needs more hair. In general, a breaking load of the joining hair 12 is 100 to 250 g, and preferably 200 to 250 g. A diameter of the joining hair is preferably 60 to 80 μm. One unit of the joining hair 12 may consist of a single strand of joining hair 12. In this case, for tying the joining hair 12 to the rod member 11, the single joining hair strand constituting one unit of joining hair 12 is folded into two and in that condition, the folded-back part is wound around the rod member 11 and then, folded into two to form a ring-like portion. Thereafter, opposite ends of the joining hair 12 is pierced into the ring-like portion. By doing so, the joining hair 12 can be tied to the rod member 11. However, it is more preferred that one unit of the joining hair 12 consists of a plurality (for example, three) of joining hair strands. In this case, a glue dissolved in water is evenly applied to the surface of the joining hair 12 in such a way to form a thin layer thereon. Thereafter, the joining hair 12 with a thin layer of glue on it is left as it is for 1 to 3minutes for drying.

In order to perform the hair joining work using the above hair-joining device 10, first, a single strand of natural hair on the scalp of a person's head who needs more hair is pierced into the loop portion 13a of the rod member 11. Thereafter, the heading joining hair 12 is shifted in position and withdrawn from the rod member 11 through the loop portion 13*a*. At the same time, the natural hair is also withdrawn through the loop portion 13*a*. As a consequence, it is created a state where the natural hair is pierced into the knot portion of the joining hair 12. In that condition, when the free ends of the joining hair 12 are pulled in opposite directions, the joining hair 12 is tightly tied to the natural hair. The hair joining work will be described in more detail later with reference to FIGS. 3 and 8.

In the first embodiment, by using the loop portion 13*a* formed on the distal end of the rod member 11, the joining hair can extremely easily be secured to the natural hair on the scalp of a person's head. On the contrary, however, there is a possibility that the joining hair 12 wound around and loosely knotted to the rod member 11 is slipped to come into intimate contact with or tangle in the adjacent joining hair 12. For this reason, a hair-joining device, as hereinafter described, may be employed so that the predetermined intervals will not be shifted and so that the adjacent joining hair will not easily be tangled with each other.

Figure 2:
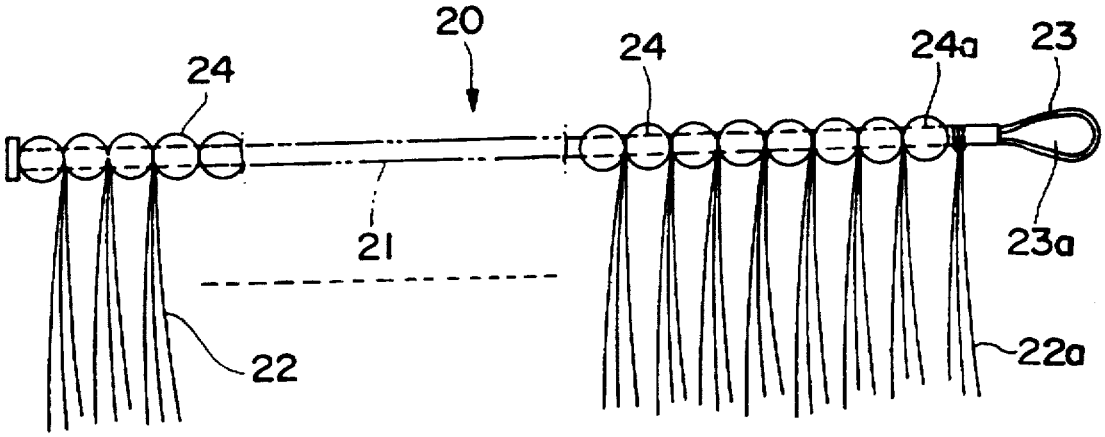
FIG. 2 is a perspective view of the second embodiment of a hair-joining device according to the present invention.

A hair-joining device 20 according to the second embodiment of FIG. 2 comprises a rod member 21, joining hair 22 wound around and loosely knotted to an outer peripheral surface of the rod member 21 at predetermined intervals, a loop portion 23a formed of a filament 23 which is formed on a distal end side of the rod member 21 in such a way to project therefrom and which has flexibility, and a plurality of beads 24 loosely fitted to the rod member 21. The joining hair 22 and the beads 24 are arranged on the rod member 21 in alternate relation.

Figure 3A:
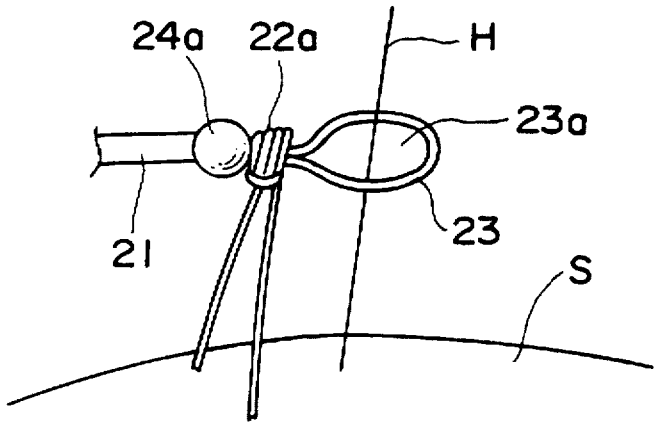
FIG. 3 is a schematic view showing the various steps for performing a hair joining work using the hair-joining device of the second embodiment.
Figure 3B:
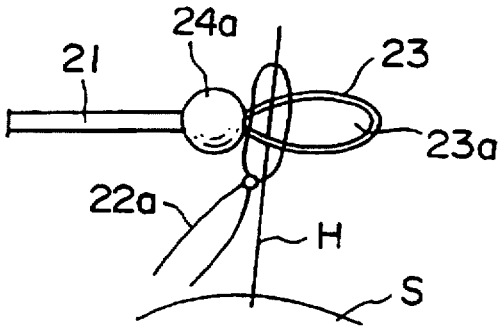
Figure 3C:
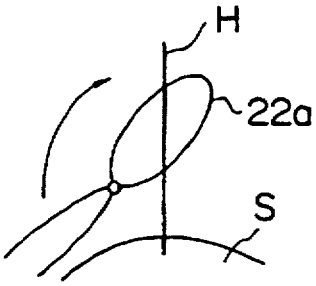
Figure 3D:
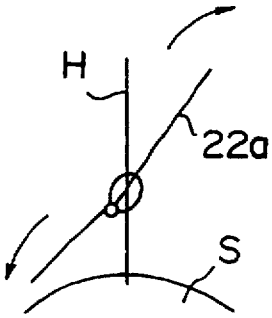
Figure 3E:
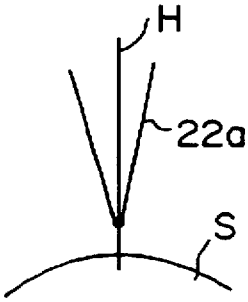

As shown in FIGS. 3 (A) through 3(E), in case the hair joining work is performed using the above hair-joining device 20, first, as shown in FIG. 3(A), a single strand of natural hair H on the scalp of a person's head who needs more hair is pierced into the loop portion 23*a*formed on the distal end of the rod member 21, and then, the heading bead 24*a* is slidingly moved to press the joining hair 22*a* located forwardly thereof. Subsequently, the bead 24*a* is withdrawn through the loop portion 23*a*. The sliding movement of the bead 24*a* causes the bead 2*a* to push the joining hair 22*a*, which is located on the loop portion 23*a* side, so that the joining hair 22*a* is withdrawn from the filament 23 together with the bead 24*a*. When the loop portion 23*a* of the filament 23 is withdrawn from the natural hair H under the principles of threading a needle, the natural hair H is pierced into the knot of the joining hair 22*a* as shown in FIG. 3(C). Lastly, when opposite ends of the joining hair 22*a* are pulled in opposite directions as shown in FIG. 3(D), the joining hair 22*a* is tightly tied to the natural hair H as shown in FIG. 3(E). This procedure is repeated as often as the number of the units of the joining hair strands in order to perform the hair joining work. Reference character S denotes a surface of the scalp of a person's head who needs more hair.

According to the hair-joining device of the second embodiment, since the joining hair 22 is located at the predetermined intervals because of a provision of the beads 24, it hardly happens that the joining hair 22 is shifted to come into intimate contact with and tangle in the adjacent joining hair 22.

However, there still remain such problems that the work for slidingly moving (or passing) the beads 24 along the rod member 21 which is pierced into and extends through the beads 24 is time consuming and troublesome, and the beads 24 must be recovered after they are withdrawn from the rod member 21 during the hair joining work.

In view of the above, the third embodiment of a hair-joining device of FIGS. 4 and 5 will be described as the most preferred embodiment of the present invention.

Figure 4:
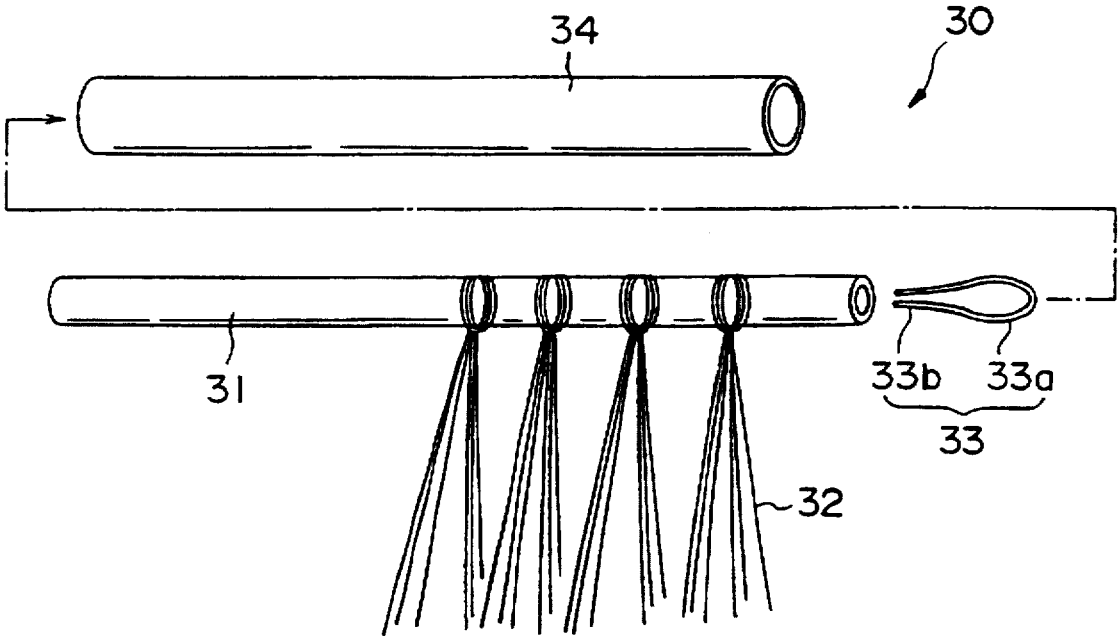
FIG. 4 is an exploded perspective view showing the third embodiment of a hair-joining device according to the present invention.

FIG. 4 is an exploded perspective view of the third embodiment of a hair-joining device 30 according to the present invention.

A hair-joining device 30 generally comprises an inner rod member 31 made of plastic, joining hair 32 wound around and loosely knotted to an outer peripheral surface of the inner rod member 31at predetermined intervals, a flexible filament 33 opposite ends 33*b* of which are secured to the inner rod member 31 and an intermediate loop portion 33*a* of which projects from one end of the inner rod member 31, and an outer cylindrical member 34 for receiving therein the inner rod member 31 with the joining hair 32 wound around and loosely knotted to the inner rod member 31 and with at least the loop portion 33*a* of the filament 33 projecting from one end of the outer cylindrical member 34.

Figure 5:
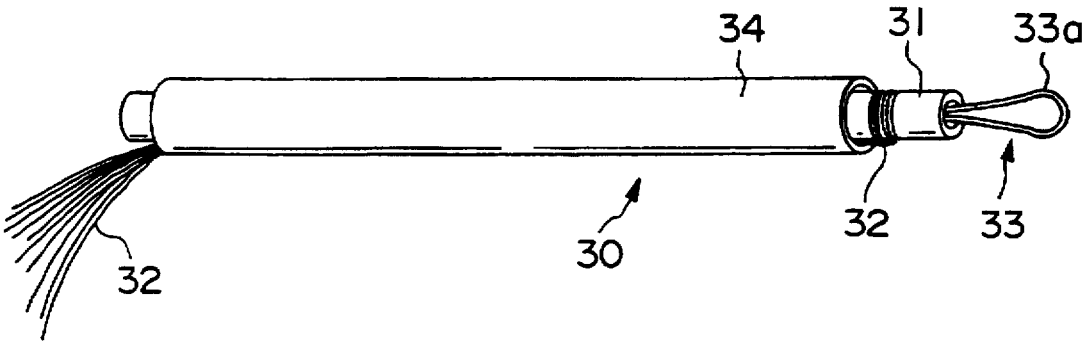
FIG. 5 is a perspective view of an assembled state of the hair-joining device of FIG. 4.

As shown in FIG. 5, the inner rod member 31 with the joining hair 32 wound around and loosely knotted to the joining hair 32, is fully inserted into the outer cylindrical member 34 first with the loop portion 33*a* side and nested therein. As a consequence, the loop portion 33*a* on the distal end of the inner rod member 31 projects from the other end of the outer cylindrical member 34.

In this embodiment, although the inner rod member 31 is formed into a cylindrical body, the present invention should not be limited to the cylindrical body. It may takes other any configurations inasmuch as the opposite ends 33*b* of the filament 33 having the loop portion 33a are secured to its rod-like one end. Similarly, the outer surface configuration of the inner rod member 31 should not be limited to the planar one as shown in FIG. 3, either. In the alternative, the inner rod member 31 may be provided on its outer surface with small irregularities in order to prevent the joining hair from being tangled with each other which would otherwise be likely to occur when the joining hair wound around and loosely knotted to the inner rod member 31 is slidingly moved.

Referring next to FIG. 6, there will be described a method for winding and loosely knotting one unit a plurality of strands of joining hair 32 around and to the outer peripheral surface of the inner rod member 31, in the hair-joining device 30 according to the third embodiment.

Figure 6A:
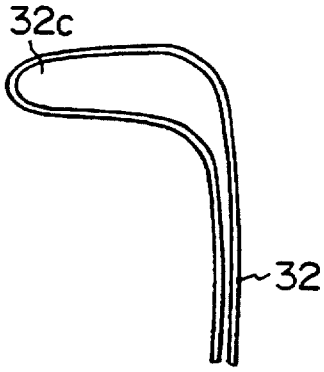
FIGS. 6(A) through 6(I) each show a schematic view in each step of one example of the method for winding joining hair to a rod member and loosely knotting the same to the rod member.
Figure 6B:
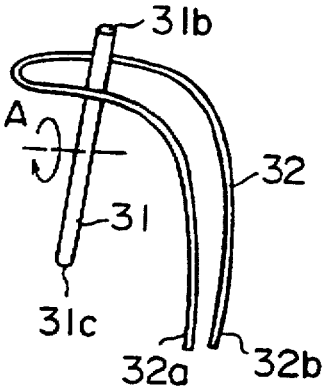
Figure 6C:
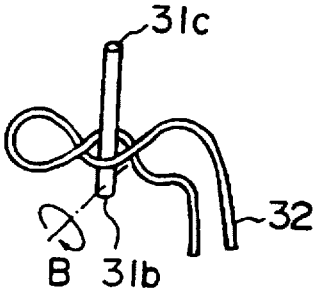

First, as shown in FIG. 6(A), the joining hair is folded into two and held with a hand, and then, as shown in FIG. 6(B), the inner rod member 31 is inserted into a U-shaped portion 32*c* formed by folding the joining hair 32 into two. Then, the inner rod member 31 is rotated in a direction as indicated by an arrow A with one half 32*b* of the joining hair 32 hooked on or astride one end 31*b* of the inner rod member 31, so that the joining hair 32 describes a figure eight as shown in FIG. 6(C).

Figure 6D:
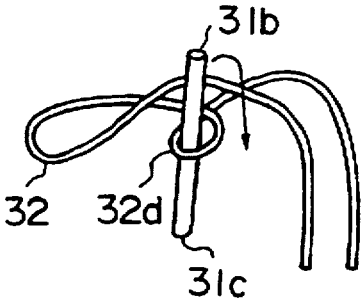
Figure 6E:
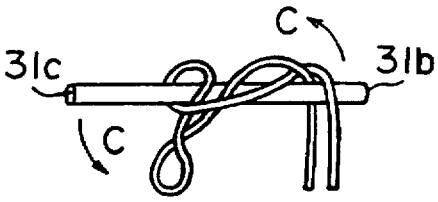
Figure 6F:
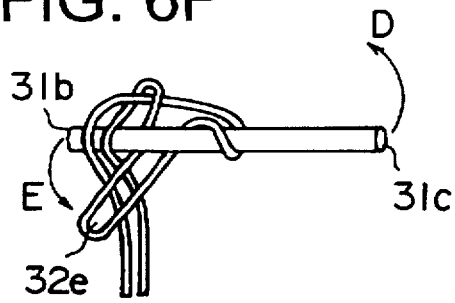
Figure 6G:
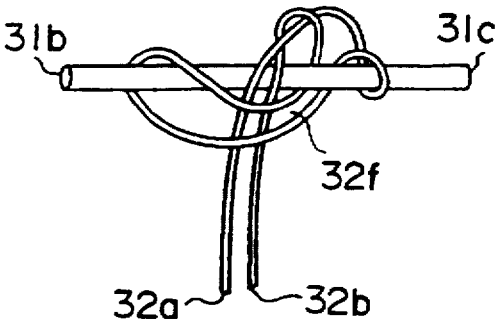
Figure 6H:
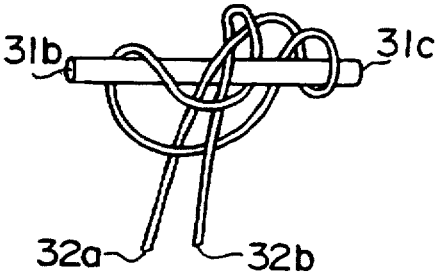
Figure 6I:
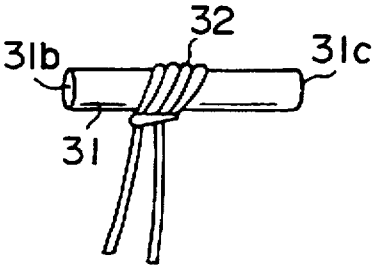

Then, the inner rod member 31 is rotated clockwise as indicated by an arrow B, so that a ring 32*c* is formed as shown in FIG. 6(D). Subsequently, as shown in FIG. 6(E), the one end 31*b* side of the inner rod member 31 is rotated downwardly, as indicated by an arrow C, from an area where the two halves 32*a*, 32*b* are intersected. Thereafter, as shown in FIG. 6(F), the one end 31*b* of the inner rod member 31 is twisted counterclockwise as indicated by an arrow D. As a consequence, a U-shaped portion 32*e* is formed on the joining hair 32 as shown in FIG. 6(F). Then, the one end 31*b* of the inner rod member 31 is rotated downwardly as indicated by an arrow E of FIG. 6(F) and inserted into the U-shaped portion 32*e* thus formed, as shown in FIG. 6(G). Subsequently, as shown in FIG. 6(H), the one half 32*b* of the joining hair 32 is withdrawn through a space 32*f*. Lastly, as shown in FIG. 6(I), the opposite ends 32*a*, 32*b* of the joining hair 32 are rather weakly pulled to form a loose knot. This knot is hardly loosened because the joining hair 32 is wound around the inner rod member 31 four times.

The above procedure is repeated as frequently as the number of the units of the joining hair 32 strands so that the joining hair 32 is wound around and loosely knotted to the inner rod member 31 at the predetermined intervals. By doing so, the hair-joining device 30 is accomplished.

It should be noted that the method for winding and loosely knotting the joining hair 32 around and to the inner rod member 31 is not limited to the above-mentioned method. Other any methods may likewise be employed inasmuch as the joining hair 32 wound around and loosely knotted to the inner rod member 31 can be slipped towards the loop portion 33*a* side of the filament 33 on the outer peripheral surface of the inner rod 31 and the joining hair 32 is hardly loosened when it is tightly tied to the natural hair H.

The inner rod member 31 with the joining hair 32 strands wound around and loosely knotted to it at the predetermined intervals in the manner as described above, is inserted, as indicated by one-dot chain line with an arrow of FIG. 4, into the outer cylindrical member 34 first with the end where the loop member 33*a* is formed. As a consequence, the joining hair 32 is received and nested between the outer cylindrical member 34 and the inner rod member 31. This prohibits the joining hair 32 from loosely hanging down from the hair-joining device 30. Consequently, those who are engaged in a hair-joining work, such as barbers or hair dressers, can concentrate in a hair-joining work without interfered by the joining hair 32.

Figure 7:
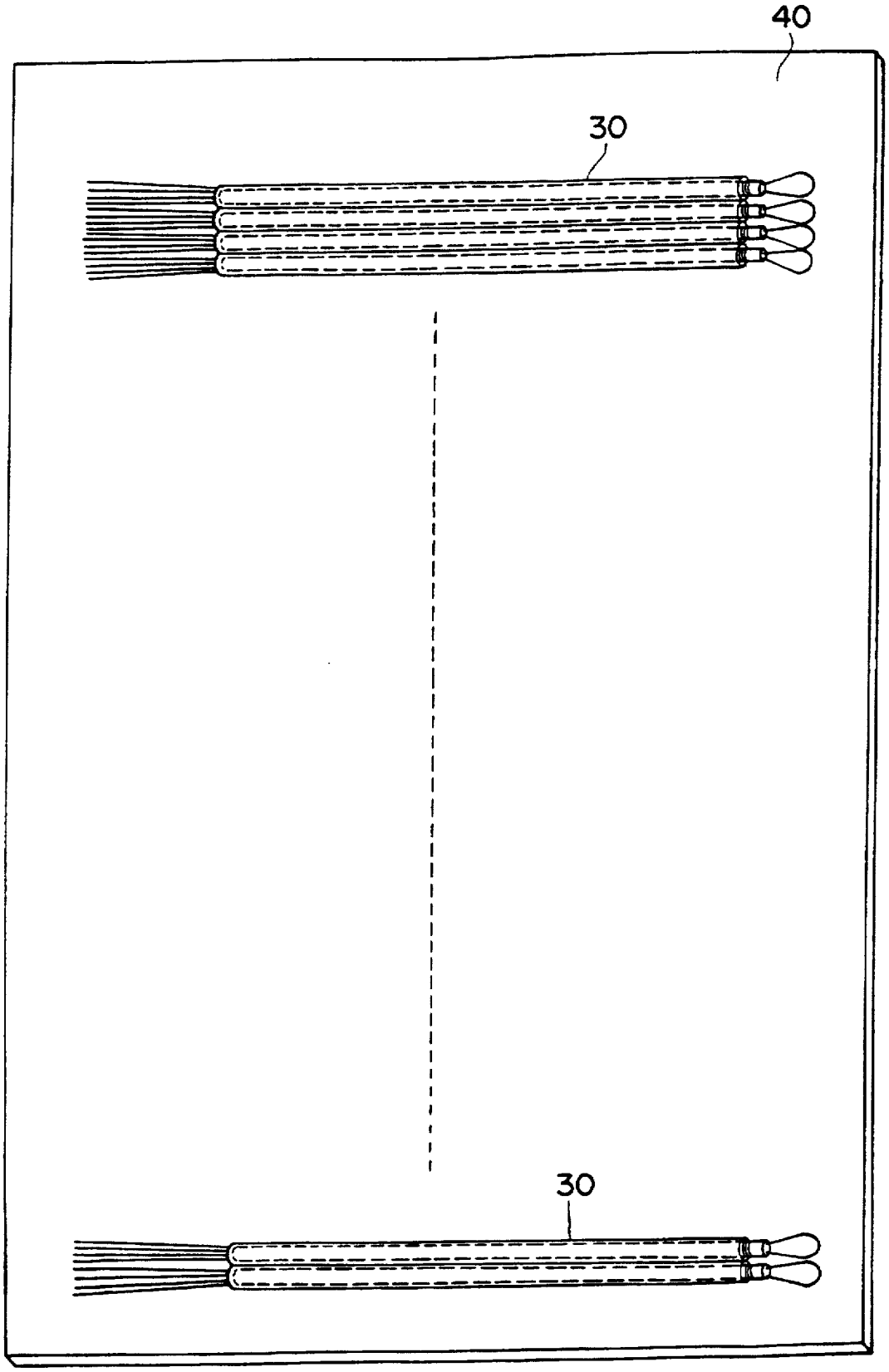
FIG. 7 is a schematic view of one example in which a plurality of hair-joining devices of FIG. 4 are fixedly arranged, in parallel relation, on a mount in order to form a large-sized hair-joining device.

If a plurality of the hair-joining devices 30 according to the present invention are beforehand prepared in the manner as described above, a hair joining work can be performed smoothly. As shown in FIG. 7, if a plurality of hair-joining devices 30 are fixedly arranged on a mount 40 in parallel relation, an amount of joining hair to be used is apparent and thus convenient. For example, by arranging fifty rows (each consisting of fifty units of joining hair strands wound around and loosely knotted to a single piece of the hair-joining device 30) of the hair-joining devices 30 on the mount 40, a total number of 2500 joining hair units can readily be used for a hair joining work. Thus, the workers and those who need more hair can enjoy tremendous benefit.

Next, with reference to FIG. 8, a method for joining hair according to the present invention using the hair-joining device 30 of the third embodiment will be described.

Figure 8A:
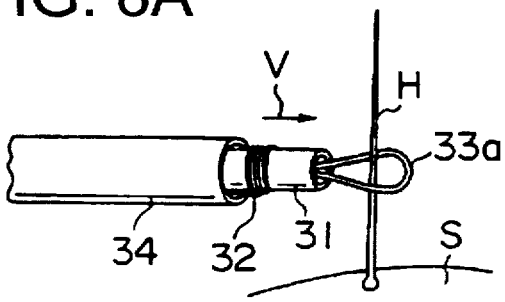
FIGS. 8(A) through 8(G) each show a schematic view in each step of a method for joining hair of the present invention which is carried out using the hair-joining device according to the third embodiment of FIG. 4.
Figure 8E:
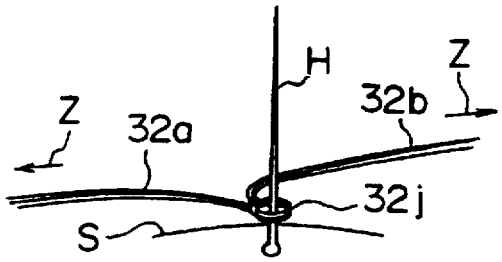
Figure 8B:
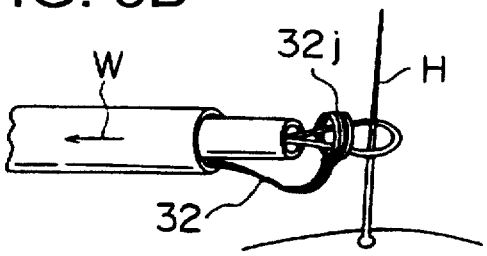
Figure 8F:
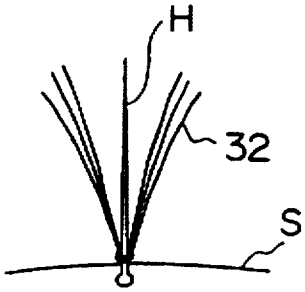
Figure 8C:
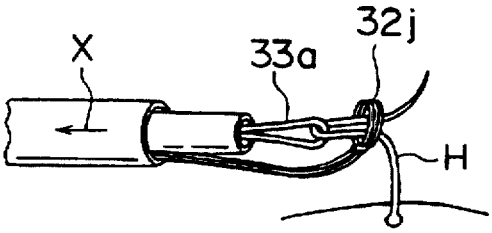
Figure 8G:
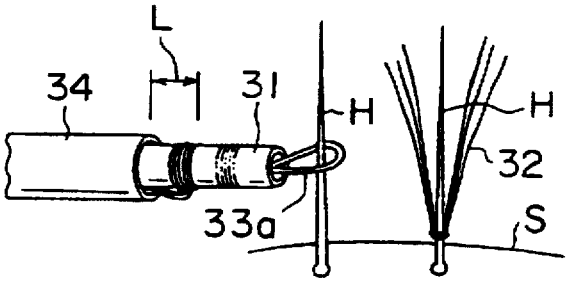

As shown in FIG. 8(A), a single strand of the hair H is inserted into the loop portion 33*a*, and the inner rod member 31 is slightly withdrawn as indicated by an arrow V. Then, a single unit of the joining hair 32 strands are pinched by fingers of one hand or caught by a needle and slidingly moved rightwardly so as to be removed from the inner rod member 31 such that, as shown in FIG. 8(B), the ring 32*j* of the knot of the joining hair 32 is located on the periphery of the loop portion 33*a*. Then, the ring 32*j* of the knot of the joining hair 32 is pinched by fingers to simultaneously move the inner rod member 31 and the outer cylindrical member 34 leftwardly as indicated by an arrow W, and then brought into the ring 32*j* of the knot of the joining hair while folding the natural hair H into two, as shown in FIG. 8(C). At that time, the free end side of the joining hair 32 is withdrawn or pulled out through a space between the outer cylindrical member 34 and the inner rod member 31. Subsequently, when the inner rod member 31 and the outer cylindrical member 34 are further moved leftwardly as indicated by an arrow X of FIG. 8(D), a single unit of the joining hair 32 is separated from the hair-joining device 30 and brought into a state where the natural hair H is loosely fitted in the ring 32*j* of the knot. Then, the ring 32*j* of the knot is pushed down towards the root portion of the natural hair H as indicated by an arrow Y, until it contacts the scalp S. Then, as shown in FIG. 8(E), by pulling the opposite ends 32*a*, 32*b* of the joining hair 32 in opposite directions as indicated by arrows Z, the knot is tightened and as a result, the joining hair 32 is tightly tied to the natural hair H. By doing so, as shown in FIG. 8(F), there is created a state where a plurality of the joining hair 32 strands are densely grown from a single strand of the natural hair H. By this, one cycle of a hair joining work is finished. Then, as shown in FIG. 8(G), the loop portion 33*a* are moved so that the natural hair H to be treated next is inserted into the loop portion 33*a*, and the inner rod member 31 is slightly withdrawn a distance L from the outer cylindrical member 34 such that next single unit of joining hair 32 strands will appear. This cycle is repeated.

Figure 8D:
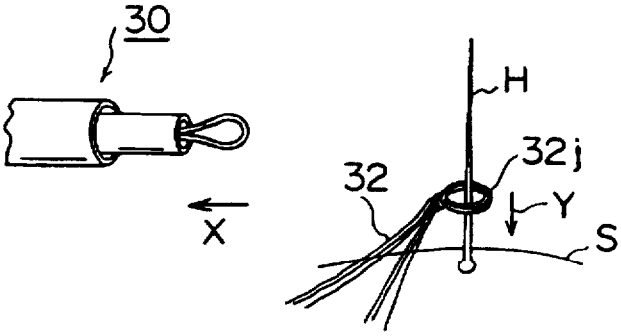

As seen, since the size of the loop portion 33*a* is unchanged in any cycle, only a desired natural hair H can be inserted into the loop portion 33*a* and thickened. Therefore, the hair joining work is remarkably enhanced. Moreover, in one cycle of the hair joining work, all the joining hair 32 units can be received in and nested in an area between the outer cylindrical member 34 and the inner rod member 31 until the state of FIG. 8(D) is created. Accordingly, since the joining hair 32 is not loosely hang down around the natural hair H, the hair joining work can extremely easily be performed. By arranging, in this way, the circumstantial conditions for a hair joining work which requires a very sensitive attention, work loads on the workers can be reduced remarkably.

Figure 9:
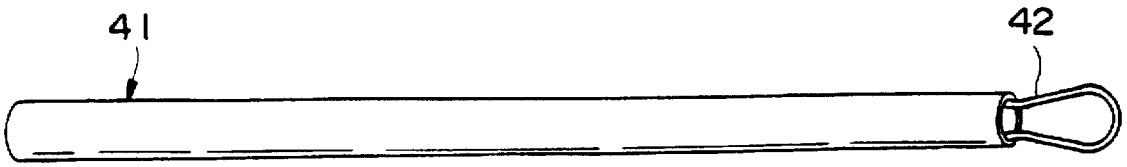
FIG. 9 is a perspective view showing another example of a rod member used for the hair-joining device of the present invention.
Figure 10:
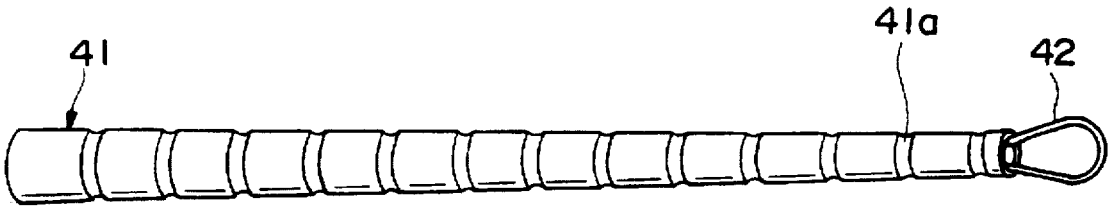
FIG. 10 is a modified example of the rod member of FIG. 9.

As the rod member or the inner rod member for winding and loosely knotting the joining hair around and to it, used for the hair-joining device according to the present invention, they are not limited to the examples shown in the various Figures but many modifications can be made. For example, as shown in FIG. 9, it is acceptable that the rod member 41 is tapered such that its basal end side is enlarged in diameter and the diameter is gradually reduced towards its distal end. Owing to the feature that the distal end is reduced in diameter, the joining hair located near the basal end side can easily be withdrawn whenever required. In order not to permit the joining hair wound around and loosely knotted to the rod member 41 to slip, as shown in FIG. 10, if a plurality of recesses 41*a* (or projects), which are each so small as just enough to receive a single strand of joining hair, are arranged around the circumference of the rod member 41 at predetermined intervals, adjacent joining hair can be prevented from being tangled with each other.

Figure 11:
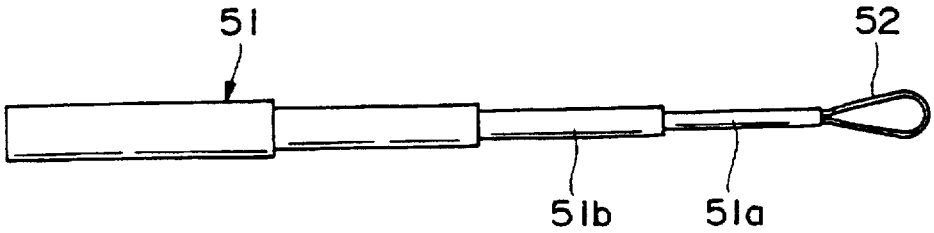
FIG. 11 is a perspective view showing still another example of a rod member used for the hair-joining device of the present invention.

Instead of the tapered rod member, the rod member may be of a multi-stage expansible type as shown in FIG. 11. In this case, after a hair attaching work is finished for the joining hair which is wound around and loosely knotted to the first rod 51*a* on a distal end side where a loop portion 52 is formed, the first rod 51*a* is inserted into the second rod 51*b*. By doing so, a sliding distance required for the joining hair can be reduced and therefore, a hair joining work can be performed in a more efficient manner.

Figure 12:
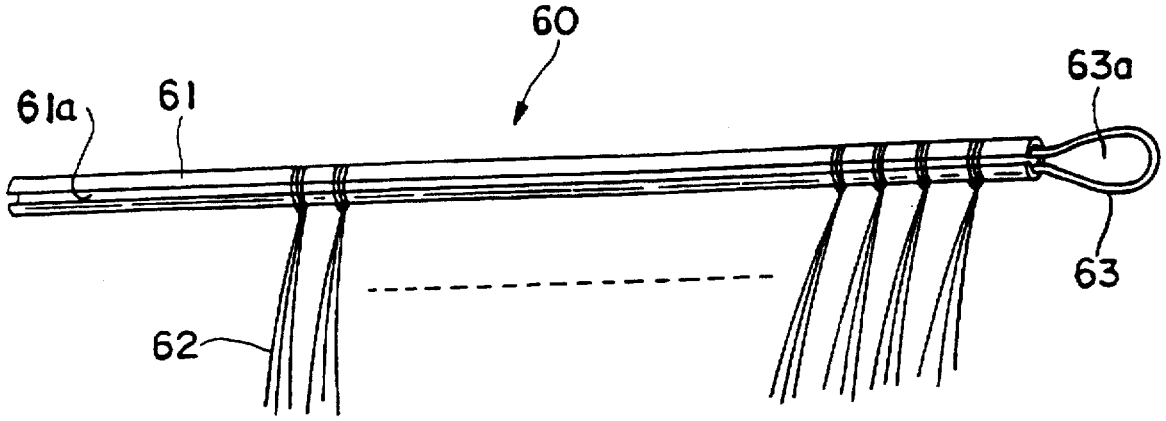
FIG. 12 is a perspective view showing still another example of a rod member or an inner rod member to be used for the hair-joining device according to the present invention.

FIG. 12 shows still another example of a rod member 61 (or an inner rod member). This rod member 61 is a sleeve-like body and provided with a cut 61*a* extending over an entire length thereof. Therefore, a sectional configuration of the rod member 61 exhibits a C-shape. Owing to a provision of the cut 61*a*, when joining hair 62 is moved towards a loop portion 63*a* side using a hook type hair implanting needle (not shown), the joining hair 62 can easily be hooked by a hook portion of the hair implanting needle and the needle with the hair 62 can easily be slidingly moved towards the loop portion 63*a* side.

In case the rod member 61 (or the inner rod member) is a solid body, it suffices that a cut (recess) having a depth just enough to insert the hook needle therein is formed in a surface of the rod member 61 in a longitudinal direction thereof.

The present invention can, of course, be applied to an intended case where a thin hair is relatively thickened. In addition, the present invention can likewise be applied to a case where, for example, the hair implanted in a wig is partially fallen out and a repairing work is required by joining hair thereto. In this case, the above-mentioned term "natural hair on the scalp of a person's head" can be referred to as "hair implanted on the wig". Therefore, those cases as just mentioned above should also be understood to be included in the scope of the present invention. It is preferred that the joining hair is jointed to a single strand of natural hair. However, in case the natural hair are rather densely existed, a single unit of joining hair strands may be jointed to two or three strands of adjacent natural hair.

What is claimed is:

1. A method for joining hair in which joining hair is tied to natural hair on the scalp of a person's head, said method including the steps of:

winding joining hair around and loosely knotting the same to a rod member, unit by unit, at predetermined intervals, which rod member is provided on one end thereof with a loop portion having flexibility;

withdrawing said joining hair wound around and loosely knotted to said rod member, unit by unit, through said loop portion after a strand of natural hair on the scalp of a person's head is inserted into said loop portion; and tightly knotting a knot portion of said joining hair thus withdrawn by pulling opposite ends of said joining hair so that said joining hair is tied to said natural hair strand at the knot portion.

2. A method for joining hair according to claim 1, wherein said joining hair, a plurality of strands of which constitute one unit of joining hair, is wound around and loosely knotted to said rod member, unit by unit, at generally equal intervals.

3. A method for joining hair according to claim 1, wherein said rod member is a cylindrical body, and said loop portion is fixedly inserted into one end of said rod member.

4. A method for joining hair according to claim 1, wherein said rod member has a plurality of beads loosely fitted thereto, and said joining hair is wound around and loosely knotted to said rod member at area between said beads.

5. A method for joining hair in which joining hair is tied to natural hair on the scalp of a person's head, said method including the steps of:

winding joining hair around and loosely knotting the same to an inner rod member, unit by unit, at predetermined intervals, which rod member is provided on one end thereof with a loop portion having flexibility;

inserting said inner rod member having said joining hair into an outer cylindrical member such that at least said loop portion of said inner rod member projects from one end of said outer cylindrical member;

withdrawing said joining hair wound around and loosely knotted to said rod member, unit by unit, through said loop after a strand of natural hair on the scalp of a person's head is inserted into said loop portion; and tightly knotting a knot portion of said joining hair thus withdrawn by pulling opposite ends of said joining hair so that said joining hair is tied to said natural hair strand at the knot portion.

6. A method for joining hair according to claim 5, wherein said joining hair, a plurality of strands of which constitute one unit of joining hair, is wound around and loosely knotted to said rod member, unit by unit, at generally equal intervals.

7. A method for joining hair according to claim 5, wherein said inner rod member is a cylindrical body, and said loop portion is fixedly inserted into one end of said inner rod member.

8. A hair-joining device comprising a rod member provided on one end thereof with a loop portion having flexibility, and said rod member having joining hair which is wound around and loosely knotted to said rod member, unit by unit, at predetermined intervals.

9. A hair-joining device according to claim 8, wherein said rod member has a plurality of beads loosely fitted thereto, and said joining hair is wound around and loosely knotted to said rod member at area between said beads.

10. A hair-joining device according to claim 8, wherein said joining hair, a plurality of strands of which constitute one unit of joining hair, is wound around and loosely knotted to said rod member, unit by unit, at generally equal intervals.

11. A hair-joining device according to claim 8, wherein said rod member is a cylindrical body, and said loop portion is fixedly inserted into one end of said inner rod member.

12. A hair-joining device according to claim 8, wherein said rod member is provided on an overall surface thereof with small irregularities so that said joining hair, which is wound around and loosely knotted to said rod member, unit by unit, will not accidentally slip.

13. A hair-joining device according to claim 8, wherein said rod member is tapered such that it is reduced in diameter on said one end side where said loop portion is provided, and gradually enlarged in diameter towards the other end side.

14. A hair-joining device according to claim 13, wherein said tapered rod member has a plurality of recesses formed therein at predetermined intervals along a circumference thereof, said recesses being so small that they are just enough in dimension to hold one unit of said joining hair, which is wound around and loosely knotted to said rod member, unit by unit, so that said joining hair will not accidentally slip.

15. A hair-joining device according to claim 8, wherein said rod member is of a multi-stage expansible type.

16. A hair-joining device according to claim 8, wherein said rod member is provided with a longitudinally-extending cut or groove.

17. A hair-joining device comprising:

an inner rod member provided on one end thereof with a loop portion having flexibility, said inner rod member having joining hair which is wound around and loosely knotted to said inner rod member, unit by unit, at predetermined intervals; and an outer cylindrical member for receiving therein said inner rod member having said joining hair such that at least said loop portion of said inner rod member projects from one end of said outer cylindrical member.

18. A hair-joining device according to claim 17, wherein said joining hair, a plurality of strands of which constitute one unit of joining hair, is wound around and loosely knotted to said inner rod member, unit by unit, at generally equal intervals.

19. A hair-joining device according to claim 17, wherein said inner rod member is a cylindrical body, and said loop portion is fixedly inserted into one end of said inner rod member.

20. A hair-joining device according to claim 17, wherein said rod member is provided on an overall surface thereof with small irregularities so that said joining hair, which is wound around and loosely knotted to said rod member, unit by unit, will not accidentally slip.

21. A hair-joining device according to claim 17, wherein said inner rod member is provided with a longitudinally-extending cut or groove.

22. A hair-joining device unit comprising a plurality of said hair-joining devices which are defined in one of claims 8 through 21, said hair-joining devices being fixedly arranged in parallel relation on a mount.

* * * * *